US007640866B1

(12) United States Patent
Schermerhorn

(10) Patent No.: US 7,640,866 B1
(45) Date of Patent: Jan. 5, 2010

(54) MOBILE VIDEO PANEL DISPLAY SYSTEM

(75) Inventor: Stephen Schermerhorn, Swannanoa, NC (US)

(73) Assignee: Widget Works, LLC, Duncan, SC (US)

( * ) Notice: Subject to any disclaimer, the term of this patent is extended or adjusted under 35 U.S.C. 154(b) by 551 days.

(21) Appl. No.: 11/713,188

(22) Filed: Mar. 2, 2007

Related U.S. Application Data

(60) Provisional application No. 60/779,384, filed on Mar. 3, 2006.

(51) Int. Cl.
*A47B 37/00* (2006.01)

(52) U.S. Cl. ..... 108/50.02; 108/5; 108/6; 312/223.3; 312/223.6; 248/923

(58) Field of Classification Search ..... 108/3–10, 108/20–22, 92–93; 312/223.1, 223.3, 223.6; 248/917, 918, 923
See application file for complete search history.

(56) References Cited

U.S. PATENT DOCUMENTS 4,469,029 A * 9/1984 Ramond ..... 108/3
4,612,863 A * 9/1986 Vonhausen et al. ..... 108/28
4,785,742 A * 11/1988 Esslinger ..... 108/6
5,287,815 A 2/1994 Gross
5,505,669 A * 4/1996 Im ..... 475/306
5,680,820 A * 10/1997 Randolph ..... 108/25
5,765,797 A 6/1998 Greene et al.
5,845,587 A * 12/1998 Ditonto ..... 108/50.01
6,288,891 B1 * 9/2001 Hasegawa et al. ..... 248/923
6,332,407 B1 * 12/2001 Vardaro ..... 108/50.01
6,493,220 B1 12/2002 Clark et al.
6,575,419 B1 6/2003 Masuda et al.
6,609,465 B2 * 8/2003 Kolavo ..... 108/50.01
6,766,994 B2 7/2004 Serbinski et al.
6,912,120 B2 * 6/2005 Kim et al. ..... 248/922
6,913,332 B1 * 7/2005 Besterfield et al. ..... 312/223.3
7,100,516 B2 * 9/2006 Riddiford et al. ..... 108/50.01
7,401,796 B1 * 7/2008 Greco ..... 312/223.3
2002/0020329 A1 * 2/2002 Kowalski ..... 108/50.01
2003/0037709 A1 2/2003 Kolavo
2004/0190236 A1 9/2004 Medica et al.
2006/0278795 A1 * 12/2006 Lee ..... 248/923

FOREIGN PATENT DOCUMENTS

DE 3622967 * 1/1988
FR 2592288 * 7/1987

* cited by examiner

*Primary Examiner*—Hanh V Tran
(74) *Attorney, Agent, or Firm*—Leydig, Voit & Mayer, Ltd.

(57) ABSTRACT

A portable, adjustable support system for large scale, flat monitors and associated hardware. The portable support system is fully self-contained and is fully adjustable so as to allow a user to interact with the monitor from a range of positions including standing, sitting, or lying down through actuated variation of the height and/or angle of the monitor.

14 Claims, 5 Drawing Sheets

MOBILE VIDEO PANEL DISPLAY SYSTEM

CROSS-REFERENCE TO RELATED APPLICATIONS

This application claims the benefit of, and priority from, U.S. Provisional Application 60/779,384 having a filing date of Mar. 3, 2006 the contents of which are hereby incorporated by reference as is fully set forth herein.

TECHNICAL FIELD

The present invention relates generally to video display platforms and more particularly to a mobile station adapted to support a flat panel display and associated peripheral equipment which is adjustable to satisfy ergonomic and operational needs.

BACKGROUND OF THE INVENTION

Portable stations incorporating video monitors are generally known. However, such portable stations typically provide limited capacity for adjustment of the video monitor and/or a work surface used in conjunction with the video monitor. In this regard, it is believed that existing systems are particularly ill equipped to incorporate large, flat panel monitors of substantial width and mass.

As will be appreciated, flat panel monitors are typically heavy, bulky, and difficult to maneuver. Moreover, the clarity of images on such monitors is typically highly dependent upon the orientation relative the viewer. Thus, a person utilizing such a flat panel monitor either as a passive viewer or as part of a workstation or other interactive system may be required to adjust his or her body position relative to the monitor in order to provide good viewing. However, such body adjustment may be undesirable and/or impractical for many users. In particular, such adjustment may cause undesirable muscular or skeletal strain if engaged in for prolonged periods of time. Likewise, persons with limited mobility such as those confined to wheel chairs or hospital beds may find such adjustment impossible to make even for short periods of time. Moreover, even for those users who can readily adjust their body positions, it may be desirable to change positions from time to time such as from a sitting to a standing orientation so as to avoid issues such as deep vain thrombosis, carpal tunnel syndrome and the like which may be more pronounced when a user maintains substantially the same position over prolonged periods. Thus, while there is a desire to utilize interactive monitors of increasing size, there is a lack of systems to support and transport such video systems and associated interactive hardware.

SUMMARY OF THE INVENTION

The present invention provides advantages and/or alternatives over the known art by providing a portable, adjustable support system for large scale, flat monitors and associated hardware. In particular, the portable support system is fully self-contained and is full adjustable so as to allow a user to interact with the monitor from a range of positions including standing, sitting, or lying down through variation of the height and/or angle of the monitor.

BRIEF DESCRIPTION OF THE DRAWINGS

The following drawings which are incorporated in and which constitute a part of this specification illustrate exemplary constructions and practices in accordance with the present invention and, together with the general description above and the detailed description set forth below, serve to explain concepts of the invention wherein.

While the invention has been illustrated and generally described above and will herein after be described in connection with certain potentially preferred embodiments and practices, it is to be understood that in no event is the invention limited to such illustrated and described embodiments and practices. On the contrary it is intended that the present invention shall extend to all alternatives and modifications as may embrace the general principles of this invention within the full and true spirit and scope thereof.

DESCRIPTION OF PREFERRED EMBODIMENTS

Figure 1:
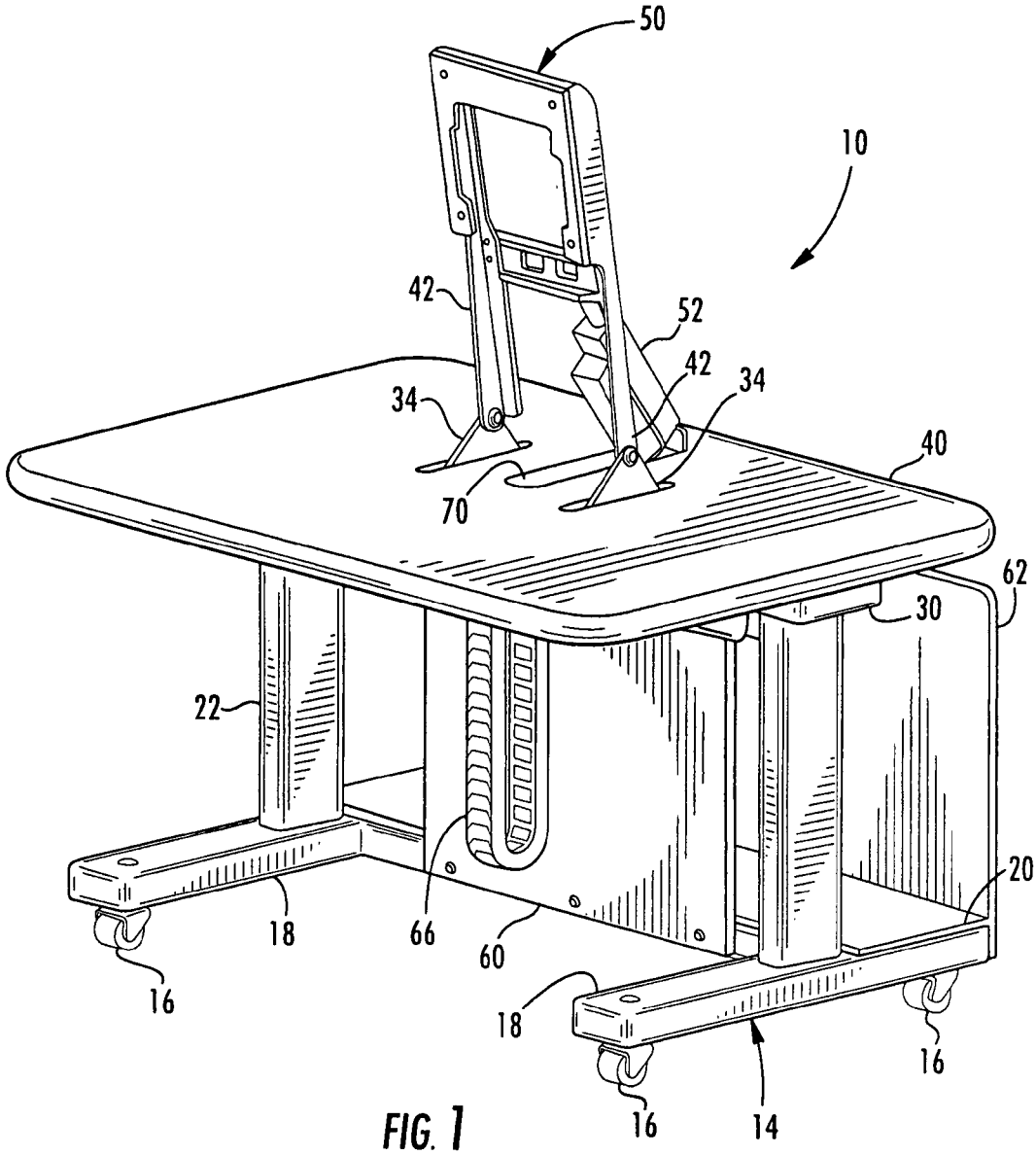
FIG. 1 is a perspective view of a fully assembled flat panel display support system in accordance with the present invention.
Figure 4:
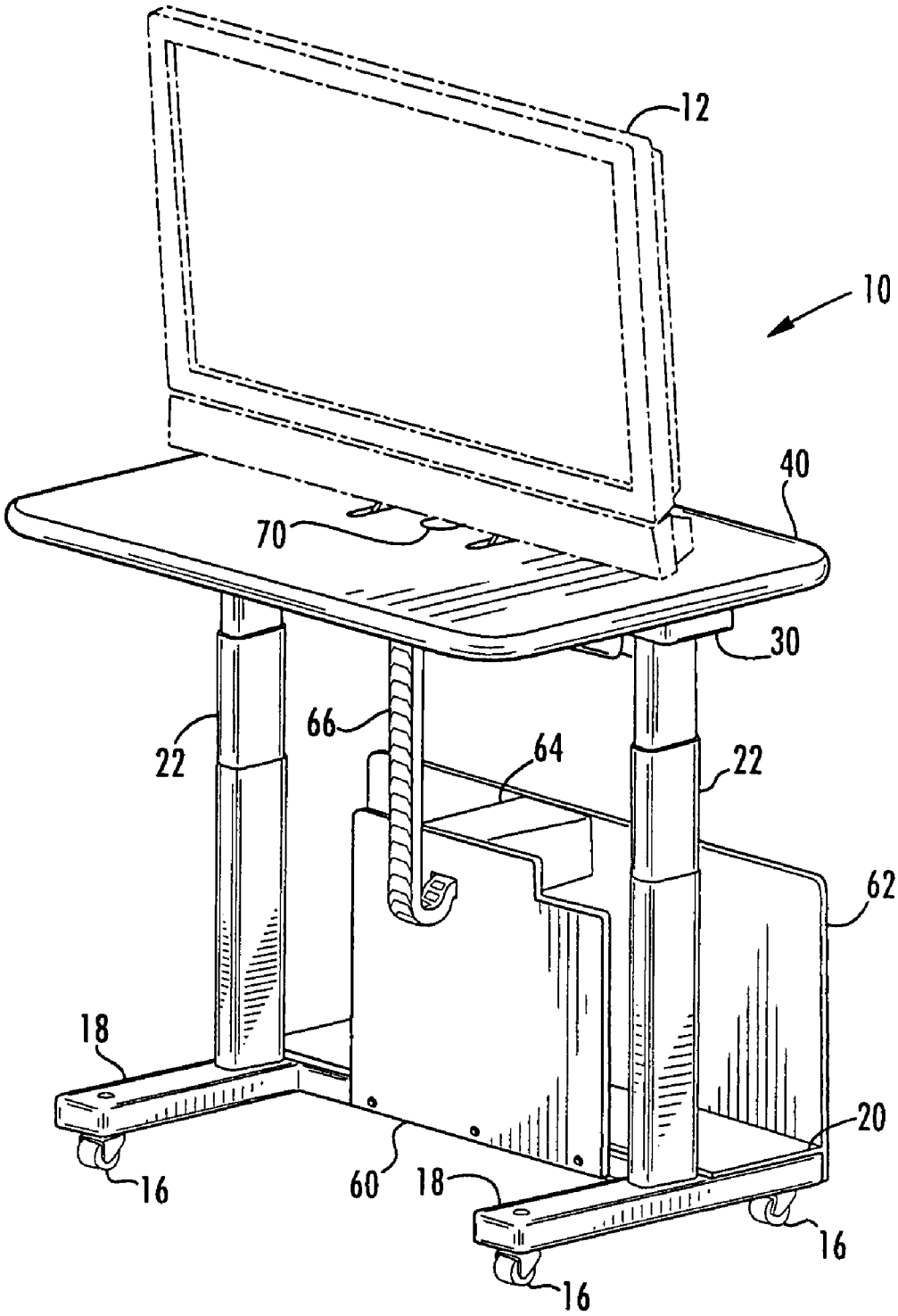
FIG. 4 is a view similar to FIG. 1 illustrating the support system in a raised elevated position.

Reference will now be made to the various figures wherein like elements are designated by like reference numerals throughout the various views. FIG. 1 illustrates a flat panel monitor support system 10 such as may be used to support a flat panel monitor 12 as shown in FIG. 4. As illustrated, the support system 10 includes a base 14 incorporating a plurality of casters 16 or the like to permit the base 14 and attached structures to be readily moved by rolling from place to place. In the illustrated and potentially preferred embodiment, the base 14 incorporates a pair of lateral legs 18 with an interconnecting support structure 20 extending between the lateral legs 18 to form a substantially "U" shaped platform framework. As will be described more fully hereinafter, the interconnecting support structure 20 may serve as a platform for housing hardware such as a computer, external drives, a DVD player or the like used in conjunction with monitor 12.

Figure 2:
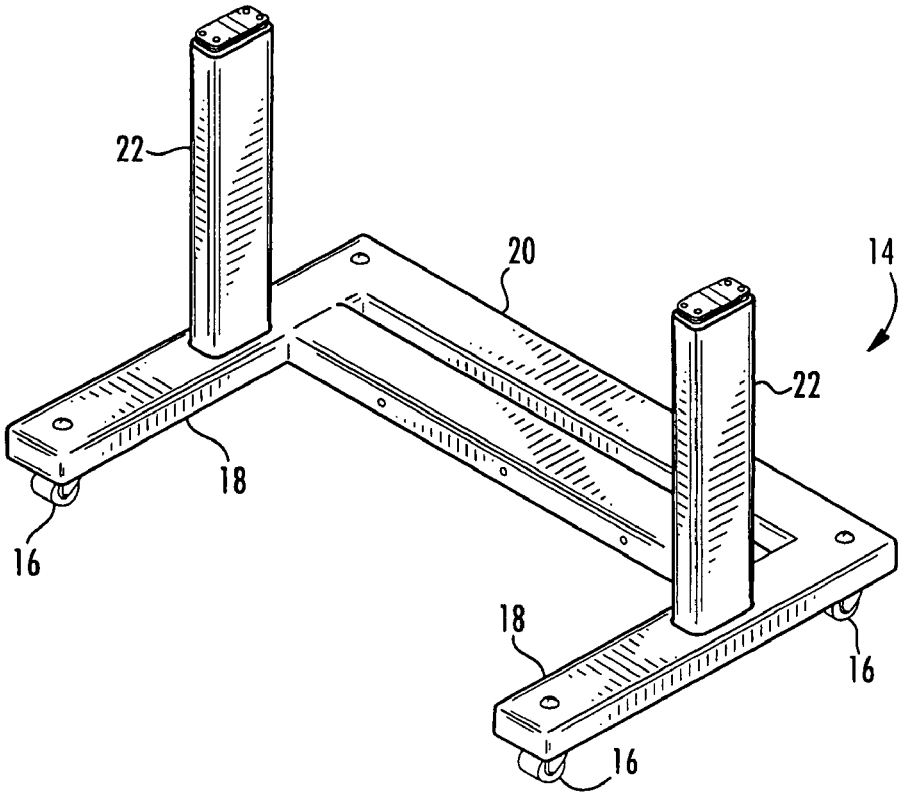
FIG. 2 illustrates an exemplary base for the support system illustrated in FIG. 1.

As best illustrated in FIGS. 2 and 4, the base 14 includes a pair of telescoping support arms 22 extending upwardly from the lateral legs 18. As shown, the support arms 22 preferably incorporate a multiplicity of telescoping segments so as to permit extension to varying heights. In this regard, it is to be understood that while the telescoping sections are illustrated as being substantially rectangular in configuration, any other suitable geometry including circular cross-sections, square cross-sections, and the like may be used as desired.

Figure 3:
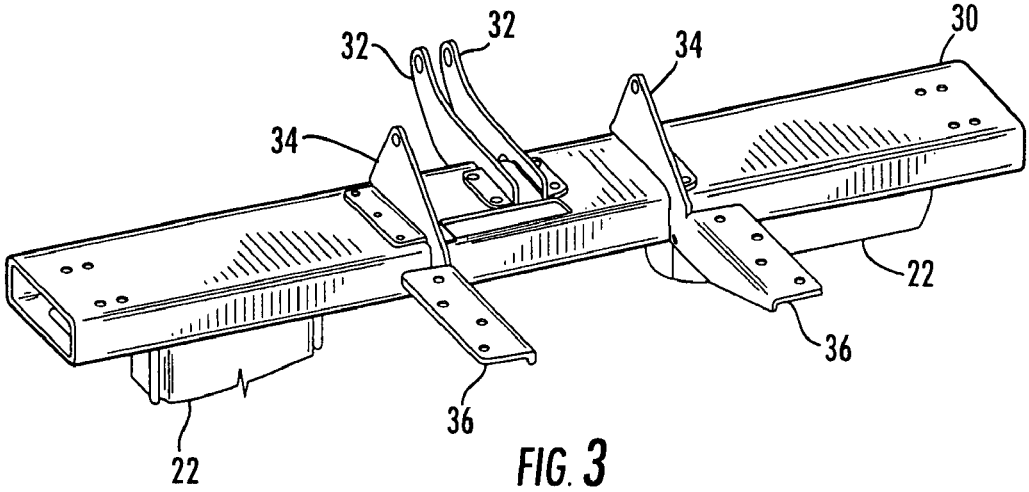
FIG. 3 illustrates an exemplary cross-member adapted for mounting on the base of FIG. 2.

As best illustrated in FIG. 3, the terminal ends of the support arms 22 are preferably attached to a cross-member 30 such as a hollow beam of rectangular beam cross-section or the like. As shown, the cross-member 30 houses a supporting framework on the beam portion including a pair of spaced finger plates 32 disposed between a pair of upwardly projecting lateral support plates 34. A pair of surface mounting plates 36 preferably extends away from the interior edge of the cross-member for mounting to an underside of a table surface 40 (FIGS. 1 and 4) such as by screws or the like.

As best illustrated in FIG. 1, the lateral support plates 34 preferably have a substantially pyramidal profile with an upper apex portion projecting through aligned slot openings in the table surface 40 for attachment to legs 42 of a mounting plate structure 50. An adjustable length linkage 52 such as a telescoping arm, extensible piston or other adjustable length structure is preferably operatively connected at a position between the upwardly curved spaced fingers 32 such as by a pin connection or the like (not shown) extending through openings in the fingers 32. The adjustable length linkage extends from the operative connection at the fingers 32 of the cross-member framework to the mounting frame of the mounting plate structure 50. Thus, by extending or retracting the adjustable length linkage 52, the mounting plate structure may be caused to rotate around the connection points between the legs 42 and the lateral support plates 34. As will be appreciated, when a monitor 12 is supported on the mounting plate structure 50, such rotation translates to a vertical tilt adjustment of the monitor 12.

It is contemplated that the extension and retraction of support arms 22 and adjustable linkage 52 may be activated and controlled by a user through use of actuators such as electromechanical motor driven actuators, mechanical actuators, pneumatic actuators or the like as will be well known to those of skill in the art. In this regard, it is contemplated that either a single actuator or multiple actuators may be used to carry out vertical adjustment so as to raise or lower the cross-member 30 and all attached components. In the event that multiple actuators are used such as a separate actuator for each of the support arms 22, such multiple actuators will preferably be synchronized so as to lift or lower in concert with one another. Of course, it is also contemplated that manual adjustment techniques such as the use of spring loaded pins engaging spaced apart openings along the length of the telescoping member may be used if desired either alone or in combination with appropriate actuating devices.

As previously indicated, the interconnecting support structure 20 running between the lateral legs 18 provides a support surface for hardware used in conjunction with the monitor 12. In the exemplary embodiment illustrated in FIGS. 1 and 4, this support surface is bounded by a forward wall 60 disposed across the interior edge of the interconnecting support structure 20 and a rear wall 62 affixed along a rear edge of the interconnecting support structure 20. In the illustrated and potentially preferred embodiment, a cable collection terminal 64 such as a hollow structural sleeve member or the like extends between the forward wall 60 and the rear wall 62 adjacent the upper edges of those walls. The cable collection terminal 64 thus assists in stabilizing the wall structures 60, 62. The cable collection terminal 64 also preferably includes openings for acceptance of cables from support devices to be fed through a flexible cable sleeve 66 mounted between the cable collection terminal 64 and an opening in the underside of the cross member 30 or other position as may be desired. Thus, cables may be run from a computer or other device housed on the interconnecting support structure 20 though the cable collection terminal 64 and into the flexible cable sleeve 66 for passage through the cross member and final exit through a slot 70 or other opening in the table surface for ultimate connection to the monitor 12.

As will be appreciated, by providing a support surface for equipment such as computers and the like in conjunction with a connection system which permits substantial adjustment of the monitor position, the entire system is readily transportable and adjustable to a wide variety of environments. In moving the system, there is no requirement to disconnect hardware from the monitor in order to move such hardware separately.

Figure 5:
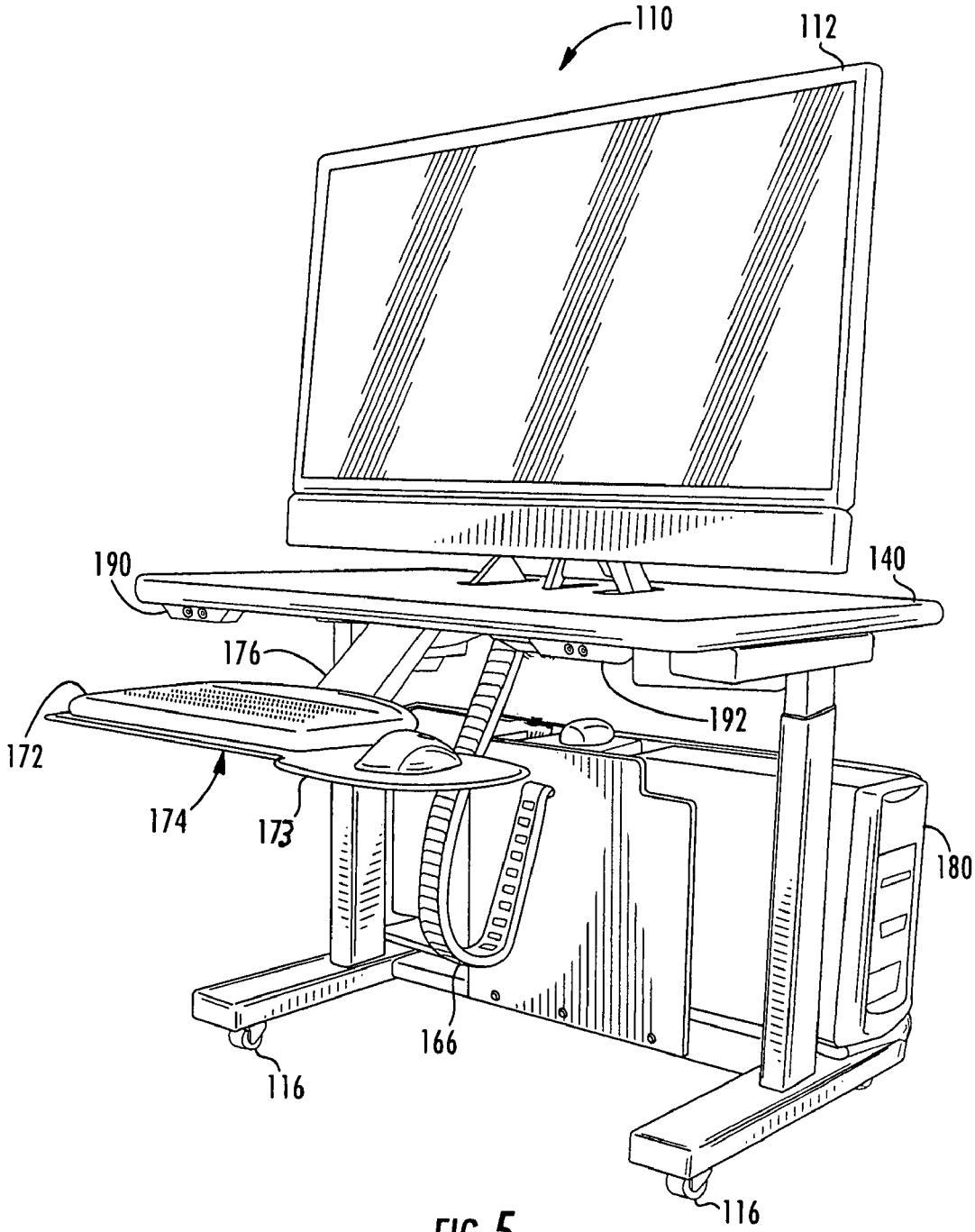
FIG. 5 is a view similar to FIG. 1 further illustrating an adjustable user interface platform supporting a keyboard and mouse.
Figure 6:
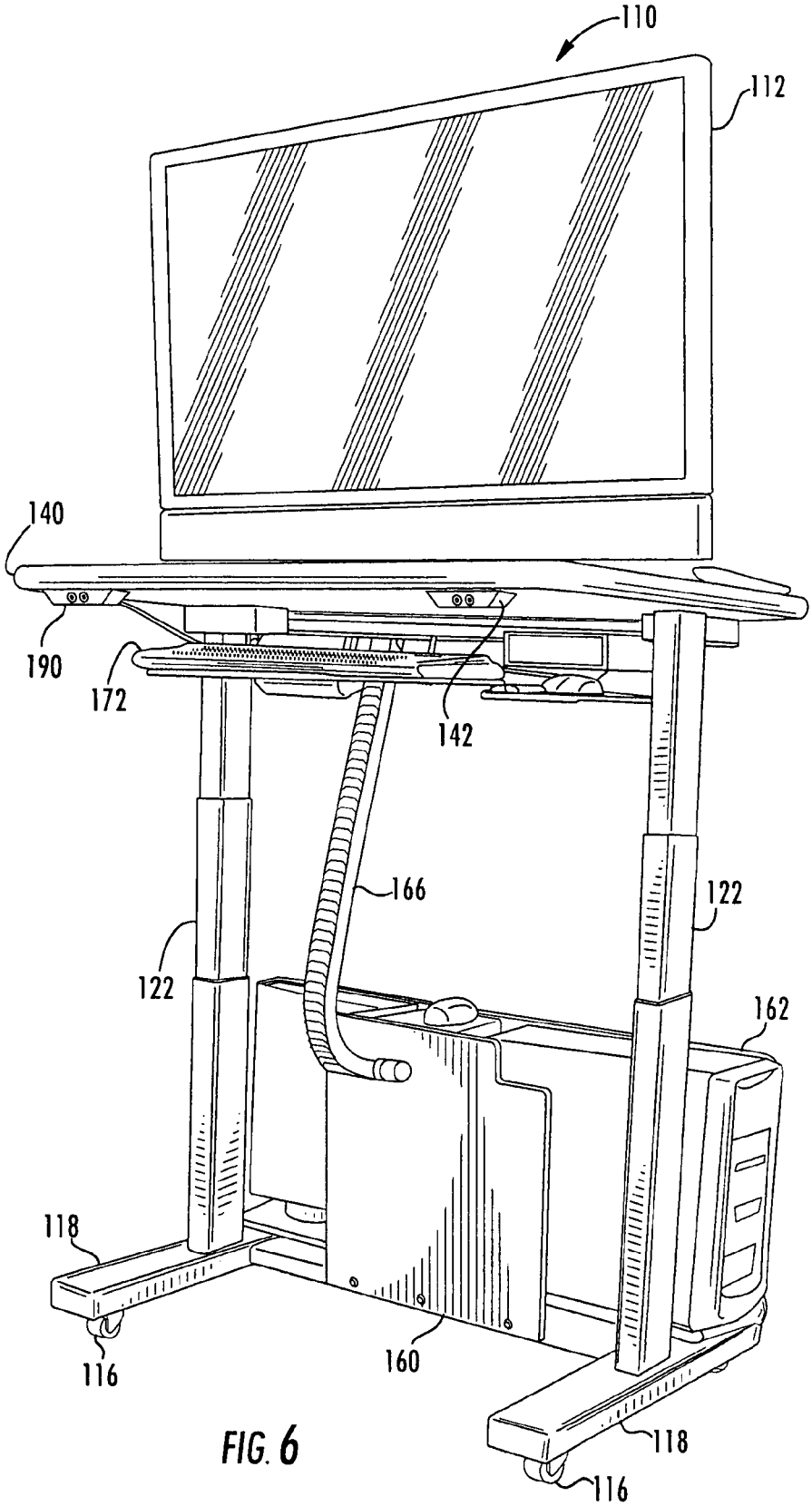
FIG. 6 illustrates the support system of FIG. 5 in an elevated condition.

As previously noted, the support system may be particularly useful as a workstation for interactive use by a person. FIGS. 5 and 6 illustrate an embodiment of the invention particularly adapted for use with a keyboard 172 or other user interface device. In these figures, elements corresponding to those previously described are designated by like reference numerals increased by 100. As shown, a keyboard support 174 is disposed at the underside of the table surface 140 held in place by an extensible arm element 176 such as a telescoping rotating arm or the like extending from the cross member. Thus, a user may pull the keyboard support downwardly and away from the underside of the table surface to a level and distance away from the table surface as may be desired for manipulation of the keyboard 172. The keyboard support 172 preferably includes an attached pad support 173 which may be used for the manipulation of a mouse or other electronic interface and/or as a support for hand writing.

In an interactive configuration as shown, the interconnecting support structure may support a computer 180 or other device operated through commands at the keyboard 172 and/or mouse. In a potentially preferred practice, the keyboard 172 and mouse are preferably wireless in order to avoid cable entanglement, however, wired hardware components may likewise be utilized if desired. A construction as illustrated in FIGS. 5 and 6 may be particularly well suited for graphics applications such as drafting and the like. However, such a construction may also be used for any number of other purposes as may be desired.

In operation, the support system 110 may be manipulated into place such as by rolling using the casters 116. Once the appropriate position is obtained, a first set of vertical actuator controls 190 may then be used to raise or lower the table surface 140 to a desired height. Upon achieving a desired height, a second set of actuator controls 192 may then be used to adjust the tilt angle of the monitor 112 so as to tilt the monitor either toward or away from a user who may be either seated or standing in front of the keyboard support. Likewise, the keyboard support 174 may be pulled down and away from the table surface to any extent as may be desired. Thus, a user is provided with at least three independent adjustments which may be used in combination to obtain a desired configuration.

As will be appreciated, the various embodiments of the invention provide substantial benefits in terms of the mobility and manipulation of systems utilizing a large flat panel monitor. In particular, both the monitor and all supporting devices including computers and the like may be readily transported from place to place without the need to disconnect components. In addition, the monitor itself may be adjusted to varying heights and/or angles without necessitating any such disconnection. Accordingly, substantially enhanced freedom of use is obtained.

It is to be understood that while the present invention has been illustrated and described in relation to potentially preferred embodiments, constructions, and procedures, that such embodiments, constructions, and procedures are illustrative only and that the invention is in no event to be limited thereto. Rather, it is contemplated that modifications and variations embodying the principals of the invention will no doubt occur to those of skill in the art. It is therefore contemplated and intended that the present invention shall extend to all such modifications and variations as may incorporate a broad concept of the invention within the true spirit and scope thereof.

The invention claimed is:

1. A portable support system for a flat panel video display, the support system comprising, a base comprising a pair of lateral legs with an interconnecting support extending transversely between the lateral legs such that the lateral legs and the interconnecting support define a platform framework, the base further comprising an arrangement of casters projecting away from an underside of the platform framework, the casters being adapted for rolling-engagement with a flooring surface, and a pair of adjustable length telescoping support arms projecting upwardly away from the platform framework;

a cross member operatively mounted between terminal ends of the telescoping support arms, the cross member comprising a beam portion, a pair of spaced apart upwardly projecting support plates oriented substantially transverse to a length dimension of the beam portion and projecting outwardly from an upper surface of the beam portion, and a pair of spaced apart upwardly curved finger plates projecting away from a rear edge of the beam portion at a position between the upwardly projecting support plates;

a table surface operatively connected to the cross member, the table surface comprising a pair of spaced apart slot openings adapted for aligned passage of upper portions of the support plates through the spaced apart slot openings, the table surface further comprising an opening between the spaced apart slot openings disposed in substantial alignment with the finger plates;

a mounting plate structure adapted for mounting a flat screen monitor, the mounting plate structure comprising a mounting frame adapted to be operatively connected to the monitor, the mounting plate structure further comprising a pair of elongate legs projecting away from the mounting frame, terminal ends of the elongate legs being held in rotateable relation to the upper portions of the support plates projecting through the spaced apart slot openings; and an adjustable length linkage extending between the curved finger plates and the mounting frame.

2. The invention as recited in claim 1, further comprising a first wall structure disposed along a forward edge of the interconnecting support and a second wall structure disposed along a rear edge of the interconnecting support to define a hardware storage compartment between the first and second wall structures.

3. The invention as recited in claim 2, further comprising a substantially rigid cable collection terminal extending between the first and second wall structures in elevated relation to the interconnecting support.

4. The invention as recited in claim 3, further comprising a flexible cable sleeve extending between an opening in the cable collection terminal and the cross member.

5. The invention as recited in claim 1, further comprising an extensible and retractable keyboard support panel operatively connected at the cross member.

6. The invention as recited in claim 5, wherein the telescoping support arms are adjustable independently of the adjustable length linkage extending between the curved finger plates and the mounting frame.

7. A portable support system for a flat panel video display, the support system comprising, a base comprising a pair of lateral legs with an interconnecting support extending transversely between the lateral legs such that the lateral legs and the interconnecting support define a platform framework, the base further comprising an arrangement of casters projecting away from an underside of the platform framework, the casters being adapted for rolling engagement with a flooring surface, and a pair of adjustable length telescoping support arms projecting upwardly away from the platform framework, the telescoping support arms being electro-mechanically actuated;

a cross member operatively mounted between terminal ends of the telescoping support arms, the cross member comprising a beam portion, a pair of spaced apart upwardly projecting support plates of substantially pyramidal profile oriented substantially transverse to a length dimension of the beam portion and projecting outwardly from an upper surface of the beam portion, a pair of spaced apart upwardly curved finger plates projecting away from a rear edge of the beam portion at a position between the upwardly projecting support plates, and a pair of surface mounting plates projecting away from a forward edge of the beam portion;

a table surface operatively connected to the cross member by connection at the mounting plates, the table surface comprising a pair of spaced apart slot openings adapted for aligned passage of upper portions of the support plates through the spaced apart slot openings, the table surface further comprising an opening between the spaced apart slot openings disposed in substantial alignment with the finger plates;

a mounting plate structure adapted for mounting a flat screen monitor, the mounting plate structure comprising a mounting frame adapted to be operatively connected to the monitor, the mounting plate structure further comprising a pair of elongate legs projecting away from the mounting frame, wherein the elongate legs are held in substantially fixed relation to the mounting frame, terminal ends of the elongate legs being held in rotateable relation to the upper portions of the support plates projecting through the spaced apart slot openings; and an adjustable length electro-mechanically actuated linkage extending between the curved finger plates and the mounting frame.

8. The invention as recited in claim 7, further comprising a first wall structure disposed along a forward edge of the interconnecting support and a second wall structure disposed along a rear edge of the interconnecting support to define a hardware storage compartment between the first and second wall structures.

9. The invention as recited in claim 8, further comprising a substantially rigid cable collection terminal extending between the first and second wall structures in elevated relation to the interconnecting support.

10. The invention as recited in claim 9, further comprising a flexible cable sleeve extending between an opening in the cable collection terminal and the cross member.

11. The invention as recited in claim 7, further comprising an extensible and retractable keyboard support panel operatively connected at the cross member.

12. The invention as recited in claim 11, wherein the telescoping support arms are adjustable independently of the adjustable length linkage extending between the curved finger plates and the mounting frame.

13. A portable support system for a flat panel video display, the support system comprising, a base comprising a pair of lateral legs with an interconnecting support extending transversely between the lateral legs such that the lateral legs and the interconnecting support define a platform framework, a first wall structure disposed along a forward edge of the interconnecting support and a second wall structure disposed along a rear edge of the interconnecting support to define a hardware storage compartment between the first and second wall structures, the base further comprising an arrangement of casters projecting away from an underside of the platform framework, the casters being adapted for rolling engagement with a flooring surface, and a pair of adjustable length telescoping support arms projecting upwardly away from the platform framework;

a cross member operatively mounted between terminal ends of the telescoping support arms, the cross member comprising a beam portion, a pair of spaced apart upwardly projecting support plates of substantially pyramidal profile oriented substantially transverse to a length dimension of the beam portion and projecting outwardly from an upper surface of the beam portion, a pair of spaced apart upwardly curved finger plates projecting away from a rear edge of the beam portion at a position between the upwardly projecting support plates, and a pair of surface mounting plates projecting away from a forward edge of the beam portion;

a table surface operatively connected to the cross member by connection at the mounting plates, the table surface comprising a pair of spaced apart slot openings adapted for aligned passage of upper portions of the support plates through the spaced apart slot openings, the table surface further comprising an opening between the spaced apart slot openings disposed in substantial alignment with the finger plates;

a mounting plate structure adapted for mounting a flat screen monitor, the mounting plate structure comprising a mounting frame adapted to be operatively connected to the monitor, the mounting plate structure further comprising a pair of elongate legs projecting away from the mounting frame, wherein the elongate legs are held in substantially fixed relation to the mounting frame, terminal ends of the elongate legs being held in rotateable relation to the upper portions of the support plates projecting through the spaced apart slot openings;

an adjustable length linkage extending between the curved finger plates and the mounting frame; and an extensible and retractable keyboard support panel operatively connected at the cross member, wherein a substantially rigid cable collection terminal extends between the first and second wall structures in elevated relation to the interconnecting support and a flexible cable sleeve extends between an opening in the cable collection terminal and the cross member.

14. The invention as recited in claim 13, wherein the telescoping support arms are adjustable independently of the adjustable length linkage extending between the curved finger plates and the mounting frame.

* * * * *